US005940942A

United States Patent [19]

Fong

[11] Patent Number: 5,940,942

[45] Date of Patent: Aug. 24, 1999

[54] FABRIC HOLDER

[76] Inventor: Mervin Fong, 83 Dahlgren Pl., Brooklyn, N.Y. 11228

[21] Appl. No.: 09/123,921

[22] Filed: Jul. 28, 1998

[51] Int. Cl.[6] ..... A41F 1/00; B42F 1/00

[52] U.S. Cl. ..... 24/459; 24/72.5; 24/108; 24/662

[58] Field of Search ..... 24/459, 522, 72.5, 24/3.12, 3.13, 302, 662, 681

[56] References Cited

U.S. PATENT DOCUMENTS

| | | | |
|---|---|---|---|
| 1,612,943 | 1/1927 | Reiter | 24/681 |
| 2,538,396 | 1/1951 | Sutin | 24/108 |
| 2,658,249 | 11/1953 | Wilson | 24/108 |
| 2,683,908 | 7/1954 | Carpinella | 24/108 |
| 2,895,199 | 7/1959 | Jones | 24/662 |
| 2,901,796 | 9/1959 | Hope | 24/108 |
| 4,985,968 | 1/1991 | Hooper | 24/3.13 |
| 5,148,560 | 9/1992 | Torres | 24/72.5 |

*Primary Examiner*—Victor N. Sakran
*Attorney, Agent, or Firm*—Mandel & Peslak, LLC

[57] ABSTRACT

What is disclosed is a fabric holder to secure a plurality of fabrics together. The apparatus comprises two pieces, a male bottom piece and a female top piece which interlock to secure the fabric.

5 Claims, 1 Drawing Sheet

FIG. A
MALE PART

SIDE VIEW SHOWING FABRIC LOCK IN PLACE

FABRIC HOLDER

BACKGROUND OF THE INVENTION

The present invention is directed to the field of fabric fasteners. The present invention is directed to a device to secure two or more pieces of fabric together, such as, a comforter and a Duvea Cover.

Generally, the currently available devices for fastening fabric comprise the use of alligator type clips which damage the fabrics or the use of a zipper, buttons or snaps, which require sewing or other modification to the fabrics. These devices do not allow the consumer to easily, and either temporarily or permanently, fasten fabric together without the danger of damaging the fabric.

The present invention is directed to a device that solves these problems. The present invention provides a means for securing fabric without the need of modifying the fabric or danger of damaging the fabrics.

SUMMARY OF THE INVENTION

It is an object of the present invention to provide a means of securing two or more pieces of fabric together. The present invention thus comprises two pieces, a bottom male piece and a top female piece.

DETAILED DESCRIPTION OF THE INVENTION

Figure 1:
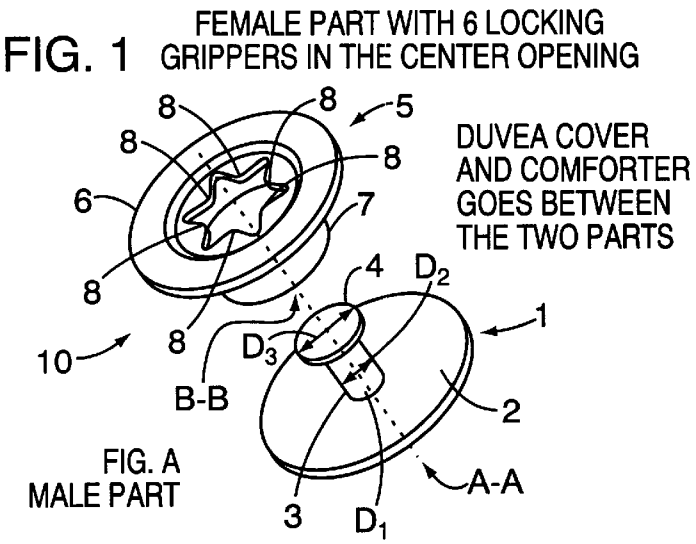
FIG. 1 is a perspective view of a device made in accordance with the present invention in the unfastened position.
Figure 2:
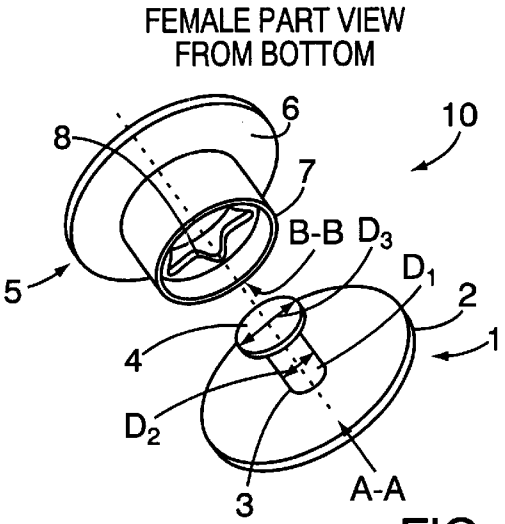
FIG. 2 is a perspective view, female top piece rotated 90 degrees upwards, of a device made in accordance with the present invention in the unfastened position.

FIGS. 1 and 2 illustrate a fabric holder according to the present invention. The fabric holder 10 comprises a bottom male piece 1 preferably constructed of flexible PBS plastic or polystyrene. In this embodiment, as shown in FIG. 1, the bottom male piece 1 has a base 2 which is generally circular. The base 2 comprises an axis A—A and is of diameter D1 as shown in FIG. 1. A center shaft 3 of diameter D2 extends upward from the base 2 and is generally aligned with axis A—A of base 2. Located on the opposite end of the center shaft 3, is a rounded end 4 of diameter D3. The diameter D3 of rounded end 4 is larger than the diameter D2 of the center shaft 3.

The fabric holder 10 further comprises a top female piece 5 preferably constructed of flexible PBS plastic or polystyrene. The top female piece 5 is comprised of a column 7. The column 7 is generally cylindrical in shape comprising an axis B—B along its length and further having an annular recess generally aligned with axis B—B. At the top of column 7, around its circumference, protruding outwards, is a ring member 6. There are a plurality of parallel finger-like projections 8 projecting inward from column 7. The projections 8 are on the same plane and are perpendicular to the axis of column 7. In the preferred embodiment of the invention there will be six projections 8.

As is known to those of ordinary skill in the art, the size of the various components of the invention may be modified to secure different types and sizes of fabrics without departing from the spirit and scope of the present invention.

Figure 3:
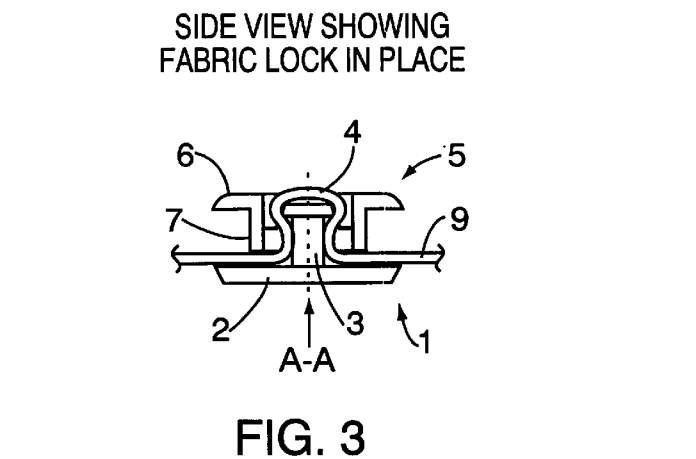
FIG. 3 is a side cross-sectional view of a device made in accordance with the present invention in the fastened position.

FIG. 3 illustrates the correct method of securing a plurality of fabrics together using the present invention. The fabrics 9 are placed between the bottom male piece 1 and the top female piece 5. The rounded end 4 is then pushed through the finger-like projections 8. This action creates tension between the fabrics and this embodiment of the present invention thereby securing the fabrics from shifting or becoming free.

Figure 4:
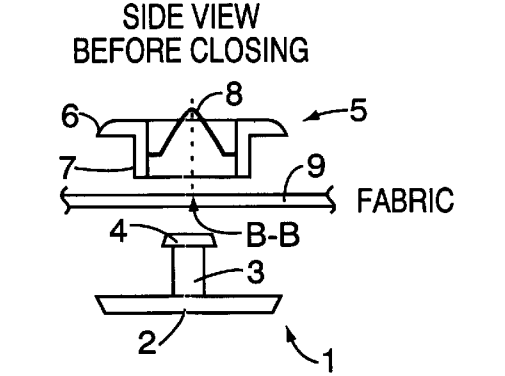
FIG. 4 is a side plan view of a device made in accordance with the present invention prior to locking the fabric.

FIG. 4 illustrates the locked position of the invention as it is securing a plurality of fabrics 9 together.

In using the invention the consumer would place a plurality of the fabric holders 10 around the perimeter of the duvea cover or decorative fabric and secure it to the perimeter of the comforter. In the preferred method of using the invention, six fabric holders 10 would be used to secure the duvea cover to a comforter. The consumer would place the duvea cover over the comforter according to the directions associated with the particular duvea cover or according to the consumer's desire as to the appearance of the duvea cover over the comforter. The consumer would place a plurality of fabric holders 10 around the perimeter of the duvea cover. To lock the fabric holder 10 into place the consumer would push the bottom male piece 1 so that the comforter and the duvea cover are forced through the projections in the top female piece 5. In the preferred method of using the invention there would be a fabric holder 10 placed at each corner of the duvea cover and one additional holder 10 placed on two opposing sides in a position equidistant apart from the respective corners.

In other embodiments to this invention, decorative caps or devices may be secured to the top female piece 5.

In view of the above, it will be seen that the several objects of the invention are achieved and other advantageous results attained.

As various changes could be made in the above constructions without departing from the scope of the invention, it is intended that all matter contained in the above description as shown in the accompanying drawings shall be interpreted as illustrative and not in a limiting sense.

In practicing the invention, the material used, so long as compatible with the specific use, and the dimensions and contingent shapes, may be any materials meeting occasional requirements.

Those of ordinary skill in the art will recognize that the embodiments just described merely illustrate the principles of the present invention. Many modifications may be made thereto without departing from the spirit and scope of the invention as set forth in the following claims.

What is claimed is:

1. A moveable fabric holder comprising:

a) a bottom male piece, which comprises a top;

b) a center shaft, extending upward from the top of said bottom male piece, which comprises a top;

c) an end member at the top of said center shaft comprising a generally blunt top surface;

d) a top female piece comprising a column;

e) said column being generally cylindrical in shape comprising an axis along its length and further having an annular recess along the axis and having a top wherein said annular recess slidingly receives the center shaft of said bottom male piece and a fabric to be temporarily secured in place between said column and said center shaft;

f) a ring member located at the top of said column, around its circumference; protruding outwards;

g) a plurality of projections located within said annular recess of said column.

2. A fabric holder as in claim 1 where said projections are on the same plane, parallel to each other and perpendicular to said axis of said column.

3. A method of securing a duvea cover to bed comforter with a moveable fabric holder comprising a bottom male piece, which comprises a top; a center shaft, extending upward from the top of said bottom male piece, which comprises a top; an end member at the top of said center shaft comprising a generally blunt top surface; a top female piece comprising a column; said column being generally cylindrical in shape comprising an axis along its length and further having an annular recess along the axis and having a top wherein said annular recess slidingly receives the center shaft of said bottom male piece and a fabric to be temporarily secured in place between said column and said center shaft; a ring member located at the top of said column, around its circumference; protruding outwards; a plurality of projections located within said annular recess of said column, comprising the steps of:

a) positioning the duvea cover over said bed comforter;

b) positioning the fabric holder so that said bottom male piece is under the bed comforter and said top female piece is over said duvea cover;

c) pushing said bottom male piece so that the comforter and duvea cover are forced through said projections in the top female piece.

4. A method as in claim 3 in which a fabric holder is placed at each corner of the comforter and duvea cover.

5. A method as in claim 3 in which a fabric holder is placed generally equidistant apart along the sides of the comforter and duvea cover.

* * * * *